United States Patent [19]

Bjertnaes

[11] 4,005,875

[45] Feb. 1, 1977

[54] SKI CONSTRUCTION OF THE TORSION BOX TYPE

[76] Inventor: Gunnar Bjertnaes, 2820 Biri, Norway

[22] Filed: Dec. 5, 1975

[21] Appl. No.: 638,280

[30] Foreign Application Priority Data

Dec. 13, 1974 Norway ..... 744504

[52] U.S. Cl. ..... 280/610

[51] Int. Cl.[2] ..... A63C 5/00

[58] Field of Search ..... 280/610, 601, 602, 607

[56] References Cited

UNITED STATES PATENTS

| | | | |
|---|---|---|---|
| 3,503,621 | 3/1970 | Schmidt et al. | 280/610 |
| 3,635,482 | 1/1972 | Holman | 280/610 |
| 3,918,731 | 11/1975 | Legrand | 280/610 |
| 3,940,157 | 2/1976 | Sakuma | 280/11.13 L |

FOREIGN PATENTS OR APPLICATIONS

| | | | |
|---|---|---|---|
| 1,916,043 | 10/1970 | Germany | 280/610 |

*Primary Examiner*—Joseph F. Peters, Jr.
*Assistant Examiner*—David M. Mitchell
*Attorney, Agent, or Firm*—Cushman, Darby & Cushman

[57] ABSTRACT

A ski of the torsion box type with a foam core and an inner torsion box provided between an outer torsion box and the core.

4 Claims, 2 Drawing Figures

SKI CONSTRUCTION OF THE TORSION BOX TYPE

Figure 1:
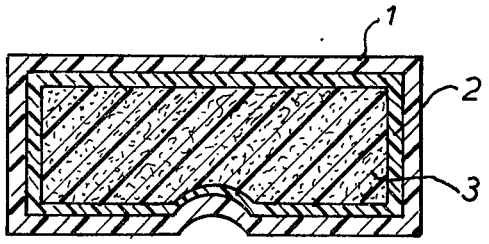

The present invention relates to a ski construction of the torsion box type having a foam core.

Skis of the torsion box type are known a typical example shown in the German publication Auslegeschrift 2,233,307 dated June 6, 1974 comprises an outer torsion box and an inner foam material core, the connection between the outer torsion box and the core material being reinforced by means of fibres which are anchored to the inside of the torsion box and which becomes anchored to the foam material core during the expansion of this material in the torsion box. Better shearing strength properties are thereby achieved between the torsion box and the foam material core so that the ski can be subjected to great bending stresses without the connection between the foam material core and the torsion box being destroyed. With the torsion box a relatively good twist rigidity of the ski construction is achieved at the same time.

The purpose of the present invention is also to provide a ski construction of the torsion box type having a foam material core with low specific weight but wherein the shearing forces between the core and the outer torsion box are transferred in such a way that there is no risk of the connection between core and torsion box loosening so as to cause relative sliding of the two materials.

This object is achieved according to the invention by providing between the outer torsion box, made of synthetic resin material with relatively high mechanical properties, and the foam core material, having relatively low mechanical properties and low specific weight, an intermediate torsion box formed of a synthetic resin material with average mechanical properties, said torsion boxes and core being firmly connected with each other.

The result is that the inner torsion box, which runs coaxially with the outer torsion box, absorbs the shearing forces which occur when the ski is bent, and reduces said forces in such a way that appreciably less shearing forces are applied to the foam material core. Therefore, when the ski is bent to a large extent, the foam material will not be torn away from the inner wall of the inner torsion box, and thus, the strength of the ski remains intact.

By the torsion boxes being placed co-axially and being connected with one another, an increased torsional rigidity of the ski is achieved. The ski may, in a known manner be provided with a running sole on its under surface and a covering layer on its upper surface in those instances where it is undesirable to use the surfaces of the outer torsion box, as the running surface and the upper surface respectively.

The torsion boxes may be formed of materials in such a way that, as seen in cross-section, they comprise a closed rings without joints. An exceptionally good torsional stability is thereby achieved.

By using synthetic resin materials which in the production of the torsion boxes and the foam core partly blend or merge with each other, a ski construction is achieved with exceptionally good torsional stability, and good bending properties.

Figure 2:
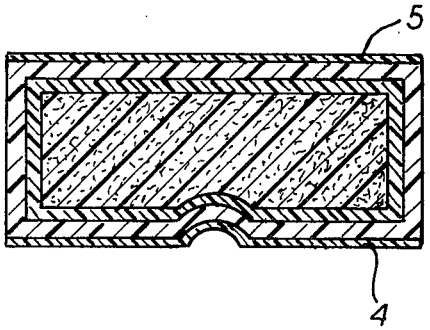

The characteristic features of the invention will be described as follows with reference to the drawing, wherein FIG. 1 shows a cross-section of a ski construction, and FIG. 2 shows the construction illustrated in FIG. 1 with a running sole and a covering layer placed on the ski's under surface and upper surface respectively.

The ski construction according to the invention, and as shown in the figures of the drawing, comprises an outer sheath of synthetic resin, namely the outer torsion box 1 and an inner sheath of synthetic resin, namely torsion box 2, which are coaxial and firmly secured to each other along their length. The inner torsion box 2 is filled with a synthetic material of low specific weight which constitutes the core 3 in the ski construction, and which is firmly connected with the inner surface of torsion box 2. The core 3 consists preferably of a foam plastic material with relatively weak mechanical properties as compared to the torsion boxes 1 and 2. The outer torsion box 1 has extremely good mechanical properties as regards tensile and breaking properties, as well as having good resistance to frictional wear and tear. There are a number of suitable synthetic resin products to choose from, for this purpose. The inner torsion box 2, which is designed to even out the shearing forces which arise between the outer torsion box 1 and the core 3 during bending and possible twisting of the ski, consists of synthetic resin material with average mechanical properties, whereby the material absorbs an appreciable amount of the said shearing forces. As a result the core 3, which e.g. consists of a relatively stiff and brittle foam plastic, is subjected to reduced strain in the connection area with the inner torsion box 2. An appreciably greater assurance is thereby achieved that the foam plastic will not break up or be deformed due to the shearing forces produced in the connection area against the inner torsion box 2.

Depending on how the ski construction is manufactured, the torsion boxes 1 and 2, as well as the core 3, will have distinct boundaries as illustrated in the drawing, or the materials used can be made to merge into each other, in such a way that distinct boundaries do not appear between the torsion boxes and between the inner torsion box 2 and the core.

In a ski construction of this type the mechanical properties of the material increase outwardly in all directions from the middle of the ski construction's cross-section so that the construction's strongest part lies in the outer areas when a cross-section of the ski construction is viewed, as shown in FIGS. 1 and 2.

FIG. 2 shows a cross-section of the ski construction corresponding to FIG. 1, but with a running sole 4 placed on the ski's under surface. The running sole can be used to obtain better resistance to frictional wear as well as to obtain either a better base for ski waxing or to give better sliding properties for special skis, such as jumping skis and slalom skis, where it is primarily important to have a smooth glide under all conditions. A covering layer 5 is provided on the upper surface of the ski.

What is claimed is:

1. A ski construction comprising:

a foam core extending longitudinally of the ski;

a first unitary torsion box surrounding said core in secured relationship therewith over the entire periphery of the core;

a second unitary torsion box surrounding said first box in secured relationship therewith over the entire periphery of the first box, said second box having higher tensile strength properties than said first box.

2. A ski construction as set forth in claim 1, wherein the core and said torsion boxes are formed of synthetic materials.

3. A ski construction as set forth in claim 1, further comprising a running sole secured to an exterior surface of said second box.

4. A ski construction as set forth in claim 3, further comprising a covering layer secured to an exterior surface of said second box on the opposite side of the second box from said running sole.

* * * * *